US009506358B2

(12) United States Patent
Bianchi

(10) Patent No.: US 9,506,358 B2
(45) Date of Patent: Nov. 29, 2016

(54) FEATHERING PROPELLER WITH BLADE DAMPENING AT FORWARD AND BACKWARD MOTION AND BLADES PITCH CONTROL DURING BACKWARD MOTION

(75) Inventor: Massimiliano Bianchi, Milan (IT)

(73) Assignee: MAX PROP S.R.L., Milan (MI) (IT)

( * ) Notice: Subject to any disclaimer, the term of this patent is extended or adjusted under 35 U.S.C. 154(b) by 818 days.

(21) Appl. No.: 13/809,275

(22) PCT Filed: Jul. 15, 2010

(86) PCT No.: PCT/IT2010/000310
§ 371 (c)(1),
(2), (4) Date: Mar. 20, 2013

(87) PCT Pub. No.: WO2012/007970
PCT Pub. Date: Jan. 19, 2012

(65) Prior Publication Data
US 2013/0202436 A1 Aug. 8, 2013

(51) Int. Cl.
*F01D 7/00* (2006.01)
*B63H 3/00* (2006.01)

(52) U.S. Cl.
CPC ..... *F01D 7/00* (2013.01); *B63H 3/008* (2013.01)

(58) Field of Classification Search
CPC ..... F01D 7/00; B63H 3/008
USPC ..... 416/43, 46, 61, 134, 136, 38, 140, 153, 416/205, 206, 209; 440/50, 52
See application file for complete search history.

(56) References Cited

U.S. PATENT DOCUMENTS

| | | | | |
|---|---|---|---|---|
| 1,370,876 | A * | 3/1921 | Caspar | 416/89 |
| 2,152,587 | A * | 3/1939 | Gemeny | 416/136 |
| 2,233,364 | A * | 2/1941 | Gemeny | 416/51 |
| 4,047,841 | A * | 9/1977 | Laurin | 416/140 |
| 4,140,434 | A * | 2/1979 | Bianchi | 416/140 |
| 5,203,675 | A * | 4/1993 | Marini | 416/140 |
| 5,232,345 | A | 8/1993 | Rocco | |
| 5,494,406 | A * | 2/1996 | Takada | B63H 1/24 416/134 R |
| 5,554,003 | A * | 9/1996 | Hall | 416/140 |
| 7,661,518 | B2 * | 2/2010 | Kimes | F16D 41/12 192/114 R |
| 8,449,256 | B2 * | 5/2013 | Bianchi | 416/43 |

FOREIGN PATENT DOCUMENTS

| | | | | |
|---|---|---|---|---|
| DE | 19823884 | A1 * | 12/1999 | B63H 3/008 |
| DE | 19823884 | B4 | 3/2006 | |
| IT | 1052002 | B | 6/1981 | |
| WO | 2008/075187 | A2 | 6/2008 | |

OTHER PUBLICATIONS

DE 19823884 English Translation.*

* cited by examiner

*Primary Examiner* — Thomas Denion
*Assistant Examiner* — Jessica Kebea
(74) *Attorney, Agent, or Firm* — Lucas & Mercanti, LLP

(57) ABSTRACT

Disclosed is a variable pitch propeller having a blade pivoted rotatably to a cylindrical propeller casing, a drive shaft, coupled to a propulsor and positioned coaxially inside the propeller casing, a kinematic mechanism coupled to the drive shaft, or to the propeller casing, and to the blade, for adjusting the rotary motion of the blade about its axis of pivoting to the propeller casing, and means for coupling in rotation the drive shaft to the propeller casing. The propeller provides a non-null angular range of relative rotation of the blade about its axis of pivoting, with respect to the propeller casing, or vice versa. The means for coupling in rotation the drive shaft to the cylindrical propeller casing include an elastic element interposed between the drive shaft and the cylindrical casing.

13 Claims, 10 Drawing Sheets

FEATHERING PROPELLER WITH BLADE DAMPENING AT FORWARD AND BACKWARD MOTION AND BLADES PITCH CONTROL DURING BACKWARD MOTION

CROSS-REFERENCE TO RELATED APPLICATION

This application is a 371 of PCT/IT2010/000310, filed Jul. 15, 2010, the contents of which are incorporated herein by reference.

FIELD OF THE INVENTION

The present invention relates to a propeller, preferably for marine use, of the variable pitch type, i.e. capable of automatically modifying the fluid dynamic pitch of the blades during operation to ensure high performance in different conditions of use. In more detail, the present invention relates to a propeller with automatic pitch variation that can also be used for navigation in reverse drive.

BACKGROUND OF THE INVENTION

For some time the use of propellers that allow navigation in reverse drive have been known, and in particular propellers that can be positioned alternately on a first pitch suitable for forward navigation and a second pitch suitable for reverse navigation The propeller blades are positioned at this angle when the direction of rotation of the propulsor is inverted with respect to the direction of rotation that allows forward motion of the watercraft.

For example, the document IT1052002, by Massimiliano Bianchi, teaches how to produce a propeller in particular for use in sailing boats, in which the drive shaft and the propeller casing are mutually coupled through two teeth coplanar and orthogonal with the axis of this propeller.

When the propeller is stationary, the blades are in "feathered" position, in a manner such as to generate minimum resistance, and the teeth of the drive shaft and of the propeller casing are mutually spaced apart in a manner such that subsequent driving in rotation of the drive shaft, both in one direction and the other, causes its idle rotation for a given angular range, which, due to an appropriate kinematic mechanism with pinion and gear wheels, corresponds to rotation of the blades with respect to the cylindrical casing.

When the drive shaft reaches the position of contact against the propeller casing, their relative rotation is inhibited, the blades are positioned with a predetermined fluid dynamic pitch.

In this manner, the propeller blades can reach a first pitch, and therefore a given angle of incidence, suitable for forward motion of the watercraft and a second pitch, suitable for reverse motion of the watercraft, depending on the direction of rotation of the drive shaft with respect to the propeller casing.

However, with a propeller of the type described above it is not possible to obtain a discrete or continuous variation of the fluid dynamic pitch when the operating conditions of the propeller vary.

That is, once the most appropriate pitch of the blades for forward drive and the most appropriate pitch for reverse drive of the watercraft has been established during the design stage, it is no longer possible for the operator to vary this angle of rotation in order to vary the pitch during operation of the propeller.

In other words, with this type of propeller it is possible only to reach a single pitch for forward motion and one for reverse motion, both established in advance during the design stage.

For this reason, when they are installed on different propulsors with respect to those for which they were designed, this causes a reduction in propeller performances in terms of efficiency.

In fact, determination of the optimal propeller pitch for forward drive and for reverse drive, is also obtained in relation to the characteristics of the propulsor, and in particular the torque delivered and the rotation speed that can be reached. In this case, modification of the propeller pitch can only be obtained by disassembling the propeller and taking action on the inside thereof with replacement of the hub or of the propeller casing, or by subjecting these elements to mechanical machining operations.

Only by performing these operations relative rotation of the drive shaft with respect to the propeller casing take the blades to be positioned with the desired pitch depending on both installation and using requirements. Naturally, the user of the propeller is not able to disassemble the propeller and replace or mechanically machine its parts alone and for this reason the work of a skilled operator is necessary or the propeller must be sent to the manufacturer.

Propellers in which the fluid dynamic pitch variation of the blades takes place automatically, by means of the propeller drive, are also known in the art. Generally these propellers comprise a cylindrical propeller casing, on which the propeller blades are pivoted according to a direction transverse to the axis of the propeller casing, or more generally perpendicular to the forward axis of the propeller, and a drive shaft, coupled coaxially to the propeller casing.

The propeller is also provided with means for transmitting rotary motion from the shaft to the propeller casing, and with a kinematic mechanism for adjusting the rotary motion of each blade about its axis of pivoting to the propeller casing, preferably adapted to transform the rotary motion of the drive shaft into a rotary motion of each blade about its axis of pivoting.

In order to allow operation of the aforesaid kinematic mechanism to transform rotation of the drive shaft into rotation of the blades, the motion transmission means allow the shaft to rotate idly with respect to the propeller casing at least for a predefined angular range. Idle rotation of the drive shaft in this angular range, with respect to the propeller casing, causes, due to the aforesaid kinematic mechanism for adjustment/transformation, relative rotation of the blades with respect to the propeller casing, with consequent variation in their angle of incidence with respect to the fluid and therefore of the fluid dynamic pitch.

A propeller of this type is described in the document WO 2008/075187, by Max Prop S.r.l., in which relative rotation of the drive shaft with respect to the propeller casing is adjusted by an elastic element interposed therebetween, which allows continuous pitch adjustment during operation.

In particular, the elastic element allows the blades to be positioned to the optimal pitch during operation, balancing the forces acting on the propeller, mainly the drive torque generated by the propulsor and the drag torque, until reaching a balanced position.

Although ensuring high performances in terms of efficiency during forward motion of the watercraft, this type of propeller cannot be used for navigation in reverse drive, as the value of the pitch in reverse drive is linked to the value of the pitch in forward drive. In other words, the two pitches are not independent from each other and for this reason it is not possible to adjust the pitch for navigation in reverse drive as this modification would cause a variation in the pitch for forward drive with non optimal values.

An object of the present invention is to provide a variable pitch propeller with automatic pitch adjustment during forward drive that does not have the limitations and drawbacks of prior art described above and that can also be used for navigation in reverse drive.

Another object of the present invention is to provide a propeller that allows automatic pitch adjustment during use in forward drive and, at the same time, allows modification of the pitch for navigation in reverse drive by the user, in a rapid and simple manner, without the need to disassemble the propeller or subject the internal parts thereof to mechanical machining operations.

SUMMARY OF THE INVENTION

These and other objects are achieved by the variable pitch propeller according to the first independent claim and the subsequent dependent claims.

The variable pitch propeller, according to the present invention, comprises at least one blade pivoted rotatably to a cylindrical propeller casing, a drive shaft, coupled to a propulsor and positioned coaxially inside the propeller casing, a kinematic mechanism coupled to the drive shaft, or to the propeller casing, and to the aforesaid blade, for adjusting the rotary motion of the blade or blades about its axis of pivoting to the propeller casing, and means for coupling in rotation the drive shaft to the propeller casing, this propeller being configured to provide at least one non-null angular range of relative rotation of the blade or blades about its axis of pivoting, with respect to the propeller casing, or vice versa.

The means for coupling in rotation the drive shaft to the cylindrical casing of this propeller comprise at least one elastic element interposed between the drive shaft and the cylindrical casing, preferably acting at least when the propulsor drives the drive shaft in rotation according to at least one direction of rotation, and at least one intermediate element interposed between the drive shaft and the cylindrical propeller casing. This intermediate element is provided with a first and with a second contact surface with the drive shaft which are mutually spaced apart by an angular space for rotation of the drive shaft with respect to the intermediate element.

Preferably, counter-clockwise rotation of the drive shaft is used for navigation in forward drive, while clockwise rotation is used for navigation in reverse drive. However, the system operates equally by producing the profiles in a mirror image manner with respect to the embodiment shown in FIG. 1. In this case, clockwise rotation of the drive shaft would be used for navigation in forward drive, while counter-clockwise rotation would be used for navigation in reverse drive.

According to a possible embodiment, the drive shaft is provided with at least one driving portion and the propeller casing is provided internally with at least one driven tooth, the intermediate element is shaped to interpose directly, or indirectly, between the driving portion and the driven tooth.

The elastic element is interposed between the intermediate element and the driven tooth, in a manner such as to adjust the relative rotation between the drive shaft and the cylindrical casing when the drive shaft rotates in both directions of rotation, and the driving portion is in the position engaged respectively with the first and the second contact surface of the intermediate element.

When the propulsor is driven in counter-clockwise direction, which as stated is preferably used for navigation in forward drive, the drive shaft reaches the position of engagement with the first contact surface of the intermediate element causing rotation of the intermediate element with respect to the cylindrical propeller casing, overcoming the resistance offered by the elastic element, which is compressed.

This relative rotation of the drive shaft and of the intermediate element with respect to the cylindrical propeller casing causes rotation of the blades with respect to the cylindrical propeller casing towards an optimal angle of incidence, and therefore an optimal fluid dynamic pitch for a given operating condition.

In fact, the elastic element allows balancing of the forces acting on the propeller, and in particular the drive torque generated by the propulsor and the drag torque caused by friction and by resistance of the fluid. Advantageously, the same elastic element also allows absorption of any impacts to which the propeller may be subjected during operation in forward drive.

When the drive shaft is driven in rotation by the propulsor in clockwise rotation direction, preferably used for navigation in reverse drive, the drive shaft reaches the position of engagement with the second contact surface of the intermediate element. Relative rotation of the drive shaft with respect to the intermediate element, in the angular space comprised therebetween, allows the fluid dynamic pitch suitable for navigation in reverse drive to be reached.

Advantageously, the propeller according to the present invention allows the pitch suitable for navigation in reverse drive to be selected and modified without the need to disassemble or replace the hub, the drive shaft, or the propeller casing.

In fact, the propeller is provided with means to adjust the angular space for relative rotation of the drive shaft with respect to the intermediate element, in a manner such that it is easy to adjust the fluid dynamic pitch of the blade or blades most suitable for navigation in reverse drive. These means to adjust the angular rotation space are interposed, preferably, between the driving portion of the drive shaft and the second contact surface of the intermediate element in a manner such as to limit rotation between the drive shaft and the cylindrical propeller casing when the drive shaft rotates in the second direction of rotation.

According to a preferred embodiment, the means to adjust the angular space for rotation of the drive shaft with respect to the intermediate element comprise at least one calibrated rod mounted on an insert.

Replacement of the calibrated rod allows the user to select and modify in a rapid and fast manner and without the burden of disassembling the propeller, the fluid dynamic pitch of the blades to be used for navigation in reverse drive.

In fact, the calibrated rod is constrained to an insert that can be easily installed and/or replaced simply by removing the tip shell, or aft shell, of the propeller. According to an alternative embodiment of the propeller according to the present invention, the means to adjust the angle of relative rotation between the drive shaft and the intermediate element consist of one or more metal pins installed in the angular space between the driving portion of the drive shaft and the second contact surface of the intermediate element.

BRIEF DESCRIPTION OF THE DRAWINGS

Further characteristics and advantages of the present invention will be more apparent from the following description, provided by way of example with reference to the accompanying drawings, wherein.

DETAILED DESCRIPTION OF SOME EMBODIMENTS OF THE PRESENT INVENTION

Figure 1:
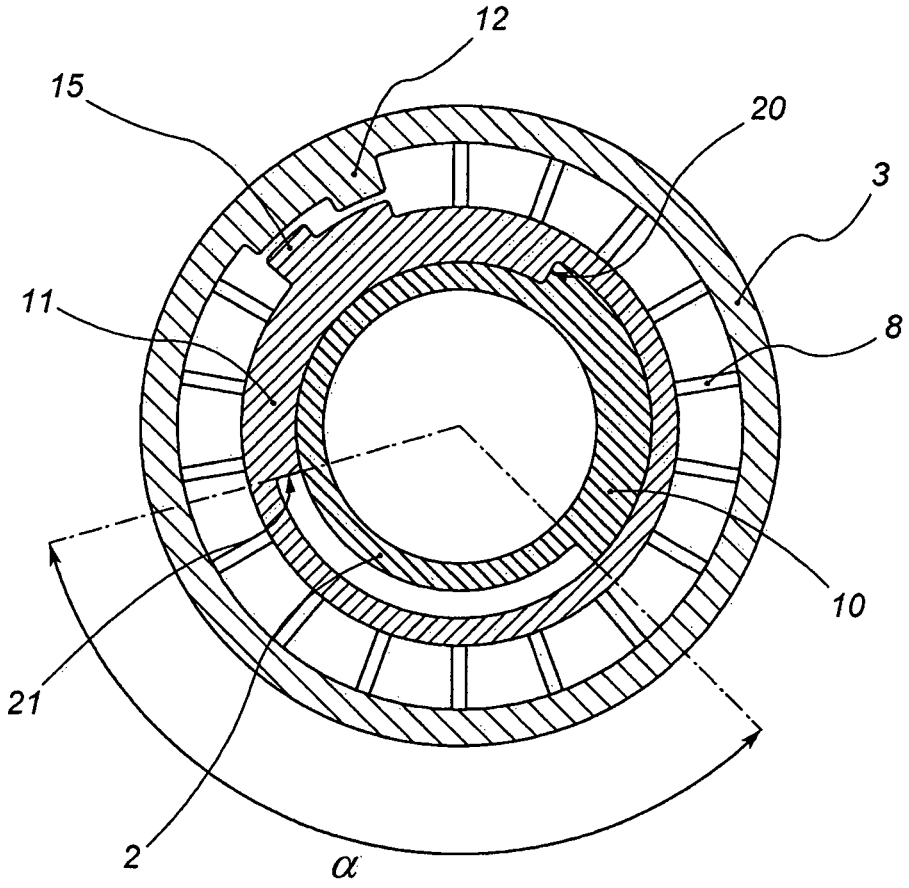
FIG. 1 is a sectional view according to a plane perpendicular to the hub, of a possible embodiment of the propeller according to the present invention.

FIG. 1 shows a preferred embodiment of the variable pitch propeller according to the present invention, preferably for marine use, which can also be used for navigation in reverse drive.

In the same manner as the propeller described in the document IT1052002, by Massimiliano Bianchi, the propeller according to the present invention comprises a hollow cylindrical casing 3 and a drive shaft driven by a propulsor, not shown in the figures.

The drive shaft is constrained according to know means to a hub 2, or this latter can consist of an end of the drive shaft.

Figure 8:
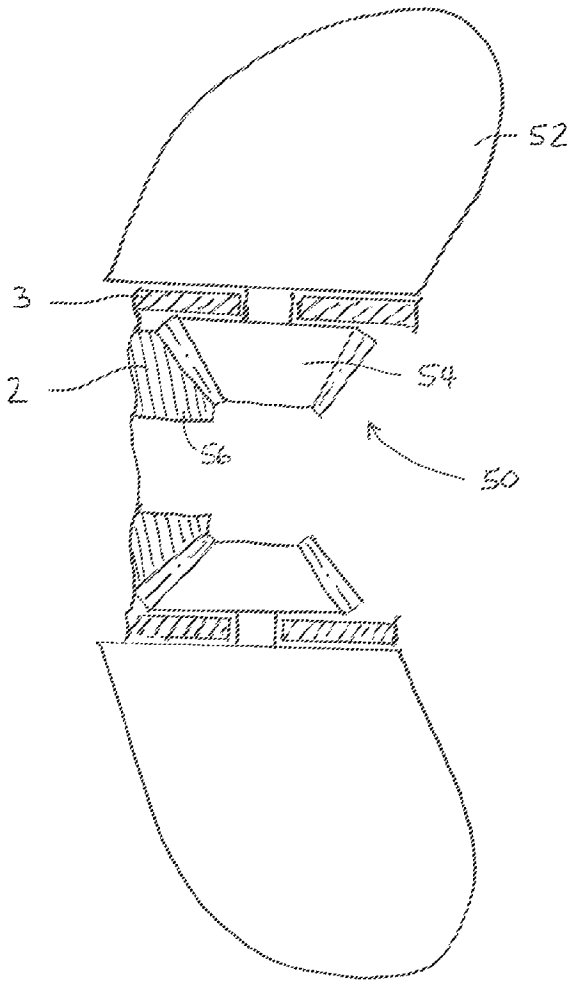
FIG. 8 shows a schematic partial sectional view of an embodiment of a kinematic mechanism used by the present invention.

As shown in FIG. 8, the propeller blades 52 are pivoted to the propeller casing 3 in a manner such that they can rotate about their axis of pivoting; in other words, the blades 52 can rotate along an axis orthogonal with respect to the axis defined by the propeller hub 2, which coincides with the drive direction of the propeller during forward and reverse motion.

The propeller according to the present invention also comprises a kinematic mechanism 50 to transform the rotary motion of the drive shaft, and therefore of the propeller hub 2 constrained thereto, into the rotary motion of each of said blades 52 about its axis of pivoting to said propeller casing 3.

In more detail, said kinematic mechanism 50 determines rotation of the blades 52 about their pivot axis, thereby varying the angle of incidence with respect to the fluid (and therefore the fluid dynamic pitch) when the drive shaft, and therefore the hub 2, rotates in relation to the cylindrical propeller casing 3 by a non-null rotation angle, or vice versa.

The kinematic mechanism 50 for transforming the rotary motion is, for example, of the type comprising a truncated-cone shaped gear pinion 54, integral with the root of each blade, i.e. at the end of the blade housed inside the propeller casing 3.

The propeller hub 2 is provided with a gear wheel integral with a central truncated-cone shaped pinion 56, which permanently meshes the pinions 54 of the respective blades, so that rotation of the central pinion 56 with respect to the cylindrical propeller casing 3 causes corresponding rotation of the blades 52 about the respective axes of pivoting to the propeller casing 3, or vice versa.

This rotation of each blade 52 about its axis causes variation of the relative angle of incidence and therefore of the fluid dynamic pitch of the propeller.

Consequently, relative rotation of the drive shaft, or of the hub 2, with respect to the cylindrical propeller casing 3 causes rotation of the blades, according to an angle that is naturally a function of the relative angle of rotation between the hub 2 and the cylindrical propeller casing 3.

The kinematic mechanism described above can naturally be replaced with equivalent means which, through relative rotation between the drive shaft, and therefore the hub 2, and the cylindrical propeller casing 3, allow variation of the fluid dynamic pitch, transforming the rotation motion of the drive shaft into rotation of the blades about their axis of pivoting, and vice versa.

As can be seen in FIG. 1, the propeller according to the present invention comprises means 8, 10, 11 and 12 for coupling in rotation the drive shaft to the cylindrical propeller casing 3 when the propulsor drive in rotation the drive shaft, and therefore the propeller hub 2, in both directions of rotation.

As will be more apparent below, the means 8, 10-12 for coupling in rotation the drive shaft to the cylindrical propeller casing 3 allow relative rotation therebetween in a non-null angular range, in order to determine the variation of the propeller pitch. These means 10-12 for coupling in rotation comprise an intermediate element 11 interposed between the hub and the propeller casing 3. The intermediate element is provided with a first and with a second contact surface 20 and 21 with the hub 2 (or directly with the drive shaft), mutually spaced apart by an angular space for relative rotation of the hub with respect to the intermediate element, indicated in the figures with the reference α. The angular space (angle α) for rotation of the drive shaft with respect to the intermediate element 11 can be adjusted through appropriate means with which the propeller according to the present invention is provided, and which will be described in detail hereinafter with particular reference to FIGS. 2 and 2A.

The hub 2, or alternatively the drive shaft of the propeller according to the present invention, comprises a driving portion 10, i.e. a sector of circumference of larger diameter with respect to that of the hub 2, which is adapted to engage, through the intermediate element 11, the driven tooth 12 produced on the inner surface of the cylindrical propeller casing 3.

The intermediate element 11 is interposed in the circumferential space between the propeller hub 2 and the cylindrical propeller casing 3, and partially occupies said circumferential space.

This space allows relative rotation of the hub 2, and therefore of the drive shaft, with respect to the cylindrical propeller casing 3 for a given angular range, in order to allow variation of the fluid dynamic pitch of the blades through the kinematic mechanism for transforming rotary motion.

As can be seen in the figures, the driving portion 10 engages the intermediate element 11 in two different positions. In other words, the intermediate element 11 is configured in a manner such as to comprise two contact surfaces 20 and 21 with the driving portion 10, depending on the direction of rotation of the drive shaft, and therefore of the hub 2.

The first surface 20 is destined for contact with the driving portion 10 when the drive shaft, and therefore the propeller hub 2, is driven in rotation in counter-clockwise direction.

On the contrary, when the direction of rotation of the propulsor is inverted, according to clockwise direction, the driving portion 10 of the hub 20 reaches the position of contact with the second surface 21 of the intermediate element 11.

Preferably, rotation in counter-clockwise direction is used for forward motion while clockwise rotation is used for reverse drive motion. As will be better described hereinafter, the angular space α comprised between the two contact surfaces 20 and 21 of the intermediate element 11 is adjustable by the user and allows the pitch of the blades to be modified, in a rapid and simple manner, for navigation in reverse drive. The propeller according to the present invention allows automatic and continuous modification of the fluid dynamic pitch of the blades when the propulsor drives in rotation the propeller hub in counter-clockwise direction, preferably used for forward motion of the watercraft, ensuring a high performance during use.

In fact, the means 8, 10-12 for coupling in rotation the drive shaft to the cylindrical propeller casing 3 also comprise an elastic element 8 that is interposed in the coupling between the propeller casing and the drive shaft.

The elastic element 8 allows automatic adjustment of the fluid dynamic pitch of the propeller as it allows adaptation of the relative rotation between the hub and the cylindrical casing in the different conditions of use, balancing the forces acting on the propeller, and in particular the drive torque generated by the propulsor and the drag torque caused by the fluid dynamic forces that act on the propeller blades.

As can be seen in FIG. 1, an elastic element 8 is interposed in the circumferential space comprised between the intermediate element 11 and the driven tooth 12, integral with the cylindrical propeller casing, which opposes the relative rotation of the drive shaft, or of the hub 2, with respect to the cylindrical propeller casing 3, and vice versa, when the propulsor imparts rotation in counter-clockwise direction on the drive shaft.

In particular, this elastic element can consist of a spring 8, whose ends are constrained to the projecting portion 15 of the intermediate element 11 and to the driven tooth 12 of the propeller casing 3. By opposing the relative rotation of the hub 2 with respect to the cylindrical propeller casing 3 the spring 8 makes the relative angular displacement of the hub 2 with respect to the cylindrical propeller casing 3 variable as a function of the forces acting on the spring 8, and therefore as a function of the drive torque of the drive shaft and of the drag torque which, through the blades, is transmitted to this cylindrical propeller casing 3.

Therefore, through the spring 8, the angular range of rotation of the drive shaft, and therefore of the hub 2, with respect to the cylindrical propeller casing 3, is variable as a function of the operating conditions of the propeller 1, and naturally, of the elastic properties of this spring.

In more detail when the propulsor imparts a counter-clockwise direction of rotation, the driving portion 10 engages at least part of the first contact surface 20 of the intermediate element 11 and causes compression of the spring 8 which opposes the relative rotation between the hub 2 and the propeller casing 3.

As the angle of relative rotation between shaft (or hub 2) and cylindrical propeller casing 3, as stated, correspondingly determines the rotation of the angle of incidence of the blades, when there is a variation in the external conditions, and specifically the drag torque on the blades and therefore the drive torque, the elastic response of the spring 8 will vary correspondingly, and consequently the possible angle of rotation of the drive shaft with respect to the cylindrical propeller casing 3 will also vary.

This causes continuous rotation of the blades with corresponding variation of their angle of incidence with respect to the drive direction that corresponds to the axis of the drive shaft, when these external conditions vary.

Moreover, given that the blades are constrained to the cylindrical propeller casing 3 in a manner free to rotate about their axis of pivoting and are also constrained in rotation to the drive shaft, or to the hub 2, in an integral manner, when there is no drive torque, the fluid dynamic stresses acting on the blades, and also the elastic return action of the spring 8 towards its undeformed configuration, will tend to make the drive shaft, or the hub, rotate to an initial position depicted in FIG. 1.

This initial or "inoperative" position, defined during the design stage, can correspond to the "feathered" position of the blades, i.e. the position in which they provide the least fluid dynamic resistance; this position is particularly convenient if, for example, the propeller is mounted on the propulsor of a sailing boat and therefore requires to offer the least possible resistance to forward motion when motor propulsion is excluded. More in general, the "feathered" position of the blades can be obtained when the driving portion 10 is in an intermediate position of the angular space α between the contact surfaces 20 and 21 of the intermediate element 11.

In the "inoperative" position, the blades can be in a predefined position with respect to the hub, called "base" pitch or initial pitch, which can be established and modified manually by the user through adjustment devices known in the art.

Moreover, it must be noted that in the embodiment of the propeller according to the present invention shown in FIG. 1, when the propeller is not operating and is in "inoperative" condition, the elastic element 8, and in particular the spring interposed between the intermediate element 11 and the driven tooth 12, is provided with an extension in under-formed condition, so that when no drive torque is applied to the drive shaft, the projecting portion 15 of the intermediate element 11 does not reach the position of engagement with the driven tooth 12 of the propeller casing 3. Again with reference to FIG. 1, when the direction of rotation of the propulsor is inverted, preferably to allow navigation in reverse drive, and therefore the hub 2 rotates in clockwise direction, the propeller allows a pitch suitable for navigation in reverse drive to be reached.

In more detail, starting from the "inoperative" position shown in FIG. 1, the hub 2 rotates in clockwise direction by the angle indicated in the figure with the reference α, until reaching the position of contact with the second surface 21 of the intermediate element 11.

As stated, rotation of the hub 2 with respect to the cylindrical propeller casing 3, and in particular relative rotation, equal to the angle α, of the driving portion 10 until reaching the position of contact with the second surface 21 of the intermediate element 11, causes modification of the pitch of the blades to obtain the pitch suitable for navigation in reverse drive.

This propeller pitch for navigation in reverse drive is established in advance and depends on the angle of relative rotation α, in clockwise direction, of the hub 2 with respect to the cylindrical propeller casing 3.

As stated, the propeller according to the present invention allows modification of the pitch suitable for navigation in reverse drive by the user without requiring to completely disassemble the propeller and carry out internal work thereon through replacement or mechanical machining of the drive shaft, of the hub or of the propeller casing.

In fact, the user can modify the pitch suitable for navigation in reverse drive manually, by varying the angle α of rotation of the drive shaft (or of the hub 2) with respect to the propeller casing 3, i.e. the angle of rotation of the driving portion 10 of the hub 2 required to reach the position of contact with the second surface 21 of the intermediate element 11.

Figure 2:
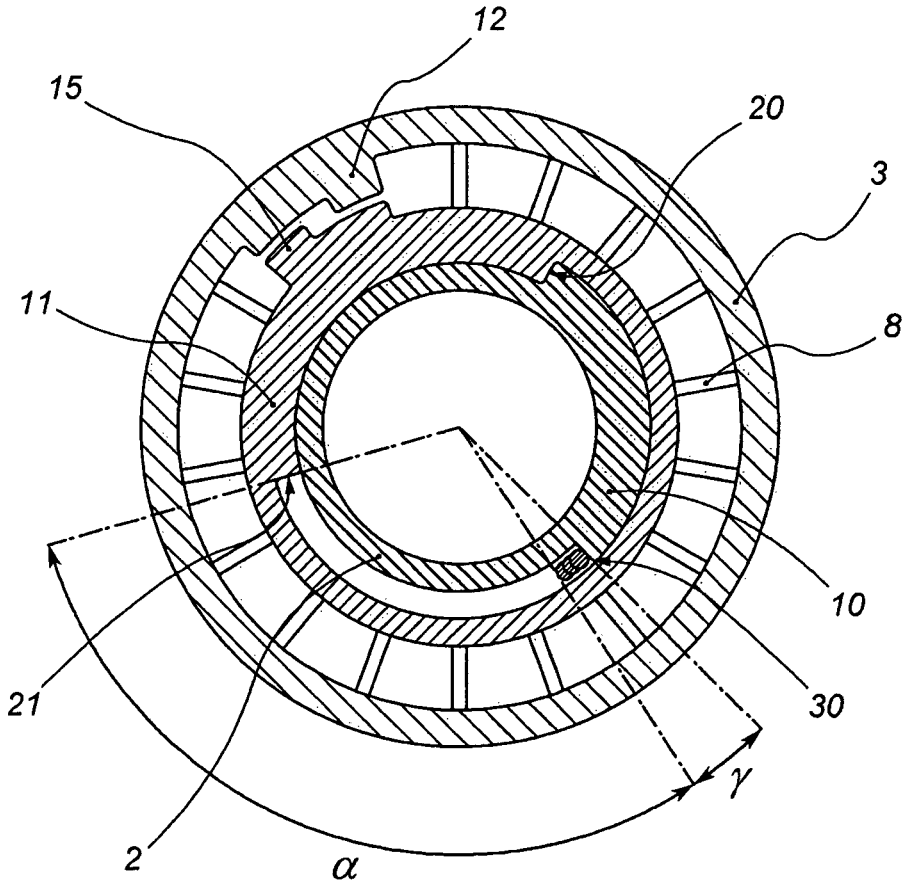
FIGS. 2 and 2A are sectional views according to a plane perpendicular to the hub of the propeller in which the means to adjust the angle α are installed according to two possible embodiments of the present invention.
Figure 2A:
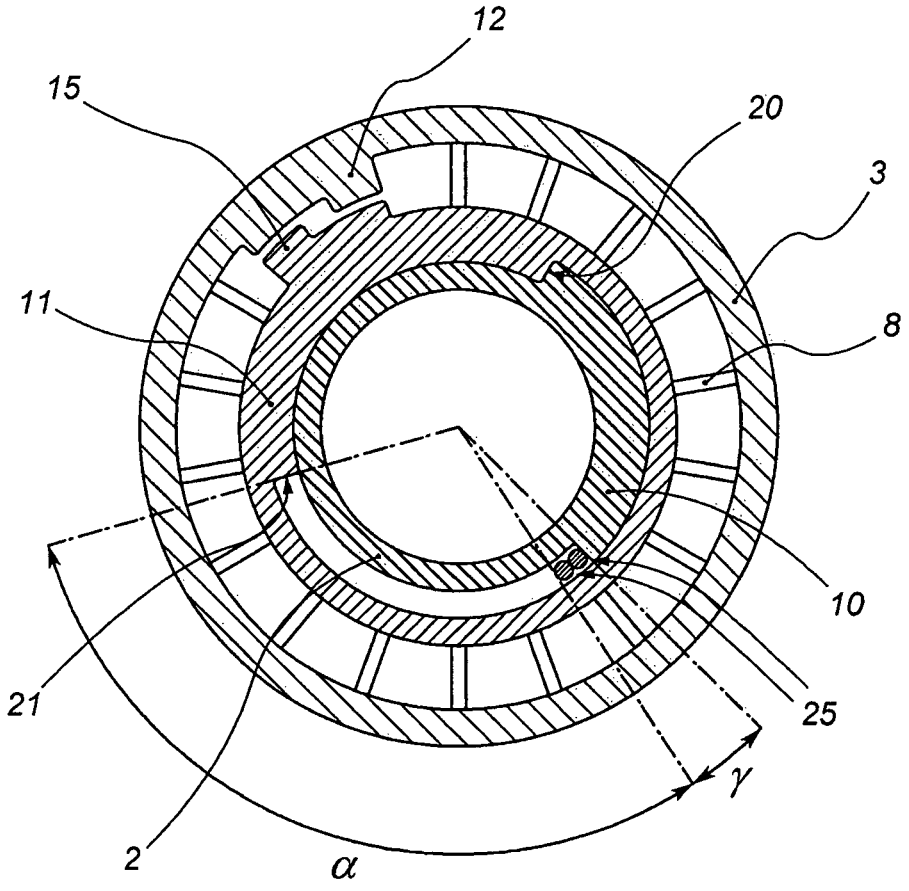

In fact, as can be seen with reference to FIGS. 2 and 2A, the propeller is provided with means to vary the angular space α for rotation of the drive shaft (and therefore of the hub) with respect to the intermediate element 11.

Figure 3:
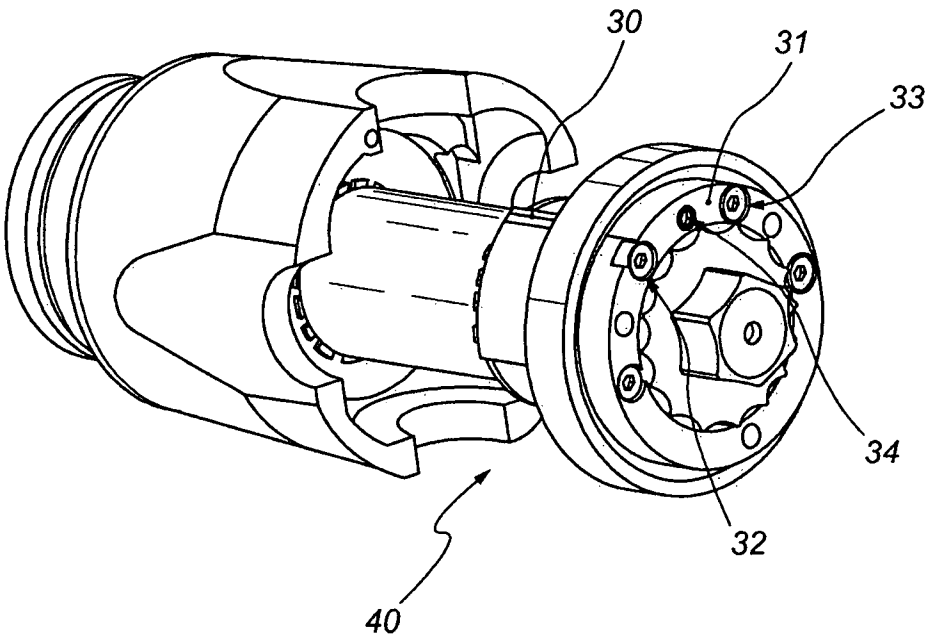
FIG. 3 is an exploded view of the aft portion of the propeller according to FIG. 2.
Figure 4:
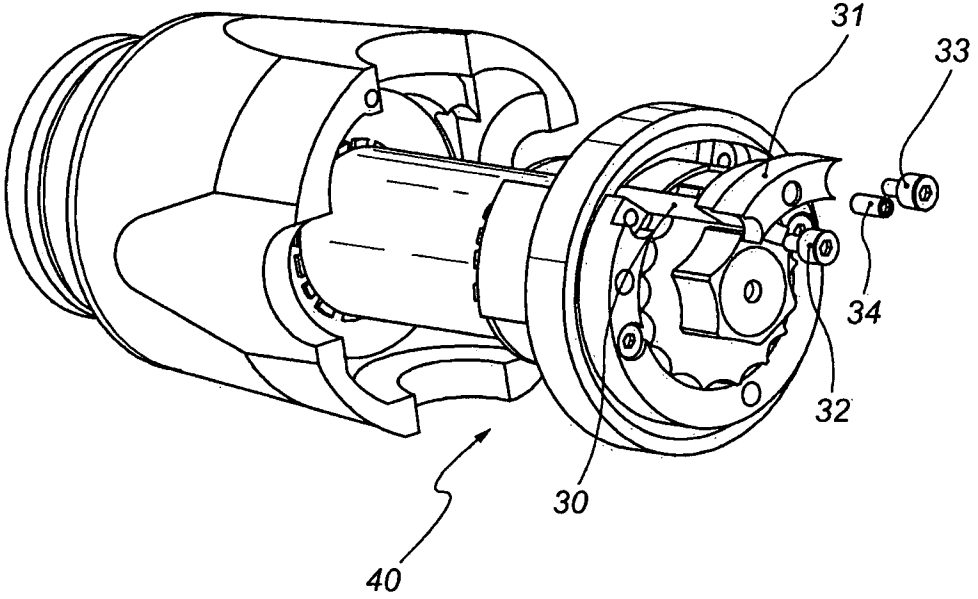
FIG. 4 shows replacement of the insert in an exploded view of the aft portion of the propeller according to FIG. 2.

As shown in FIGS. 2, 3 and 4, said means to adjust the angle α preferably comprise a calibrated rod 30, installed between the driving portion 10 and the intermediate element 11. In this manner the angle of rotation α travelled by the driving portion 10 of the hub 2 to reach the position of engagement with the second surface 21 of the intermediate element 11 is reduced.

The angle α of rotation of the hub 2 with respect to the propeller casing 3 can be modified increasing or decreasing the angle γ equal to the dimensions of the calibrated rod 30 installed.

Therefore, the propeller according to the present invention allows automatic variation of the pitch of the blades when the hub rotates in counter-clockwise direction, while when the hub rotates in clockwise direction the blades reach a predetermined fluid dynamic pitch, suitable for navigation in reverse drive, which can be varied in a simple and rapid manner before use by changing the calibrated rod 30.

In fact, the user of the propeller can vary the angle of incidence selected by installing calibrated rods of different dimensions, as shown in FIG. 2, interposed between the driving portion and the second surface of the intermediate element 11, varying the angle α of rotation between the hub and the cylindrical propeller casing.

Naturally, as will be clear at this point of the description, during the design stage it is possible to establish the pitch suitable for navigation in reverse drive reducing, or increasing, the dimensions of the intermediate element 11 or of the driving portion 10, and therefore basically varying the circumferential space available for rotation of the hub before reaching the position of contact with the second surface 21 of the intermediate element 11, indicated in FIG. 1 by the angle α. The user can proceed to modify the pitch of the blades for navigation in reverse drive according to personal using requirements and on the basis of the propulsor to which the propeller will be coupled, in a simple and rapid manner, and in particular without requiring to disassemble parts of the propeller.

As can be seen in FIGS. 3 and 4, the operations to replace the calibrated rod 30 are very simple and do not require the action of a skilled mechanic. In fact, as can be seen in FIGS. 3 and 4, which show an exploded view of the aft portion of the propeller according to the present invention, the calibrated rod 30 is secured to an insert 31 which is constrained on an end portion 40 by means of a pair of screw 32 and 33, or similar means.

The user has the choice of a plurality of inserts each provided with a calibrated rod having different dimensions with respect to the others.

The end portion of the propeller is easily accessible from the outside simply by removing the tip shell of the propeller, not shown in the accompanying figures.

For this reason, the user can carry out the adjustment of the fluid dynamic pitch suitable for navigation in reverse drive by replacing the insert 31 with another provided with the calibrated rod of the required dimensions with a few simple operations.

In particular, as shown in FIG. 4, once the tip shell of the propeller has been removed the user has free access to the end portion to which the insert 31 is constrained. Subsequently, the screws that constrain the insert to the end portion are removed and the insert is then extracted. To facilitate the operation of extracting the insert, a bushing 34 is provided to allow elimination thereof from the end portion.

Finally, the user inserts a new insert 31, provided with the calibrated rod 30 of the required dimension, terminating with fixing it by means of the screws 32 and 33. According to an alternative embodiment of the propeller according to the present invention, shown in FIG. 2A, the means for adjusting the angle of rotation α of the drive shaft with respect to the intermediate element 11 comprise one or more pins 25, made of metal material, which are installed in the angular space between the driving portion 10 of the propeller hub 2 and the second contact surface 21 of the intermediate element 11. As described previously in relation to the calibrated rods 30, with reference to the embodiment according to FIG. 2, the angle of rotation α of the hub 2 with respect to the intermediate element 11 is modified by increasing or decreasing the angle γ equal to the dimension of the metal pins 25 installed.

Operation of the propeller according to the present invention will now be summarized.

Starting from an "inoperative" position shown in FIGS. 1 and 2, application of a driving force to the drive shaft, and therefore to the hub 2, causes relative rotation of the latter with respect to the cylindrical propeller casing 3.

In the case of counter-clockwise rotation of the hub 2, the driving portion 10, being in a position of contact with at least part of the first surface 20 of the intermediate element 11, causes rotation of the intermediate element with respect to the propeller casing 3 overcoming the resistance offered by the spring 8, and thus causing compression thereof.

This relative rotation of the hub 2 and of the intermediate element 11 with respect to the cylindrical propeller casing 3, which due to inertia and to external friction remains substantially still, causes rotation of the blades with respect to the cylindrical propeller casing 3, towards an angle of incidence, and therefore an optimal fluid dynamic pitch.

In fact, the elastic element 8 allows balancing of the forces acting on the propeller, and in particular the drive torque generated by the propulsor and the drag torque caused by friction and by resistance of the fluid.

In fact, when the drive torque, the drag torque on the blades and the resistance to deformation offered by the elastic element 8 are balanced, compression of the elastic element 8 positioned between the intermediate element 11 and the driven tooth 12 of the propeller casing stops in a given relative angular position of the hub 2 with respect to the cylindrical propeller casing 3.

Consequently, the elastic element 8 behaves rigidly causing the transmission of rotary motion from the hub 2, or from the drive shaft, to the cylindrical propeller casing 3, consequently stopping rotation of the blades about their axis of pivoting to the cylindrical propeller casing 3, and therefore reaching the optimal fluid dynamic pitch for a given operating condition.

If the conditions of balance reached were to be lost, for example due to an increase in the drag torque, then the elastic element 8 would be subjected to a greater force which would cause further compression thereof, reaching a new relative angular position between the hub 2 and the cylindrical casing 3 that causes a further fluid dynamic pitch suitable for the new operating conditions to be reached.

In the case in which the conditions of balance reached are lost due to a decrease in the drag torque, then the forces acting on the elastic element 8 would decrease and this would cause a certain elongation of the elastic element 8, to reach a new relative position between hub 2 and cylindrical casing 3.

When the drive shaft is driven in rotation by the propulsor in the direction of clockwise rotation, for navigation in reverse drive, the driving portion 10 reaches the position of engagement with the second surface 21 of the intermediate element 11. The relative rotation, equal to the angle α, between the driving portion 10 of the hub 2 and the second surface 21 of the intermediate element 11 causes the fluid dynamic pitch suitable for navigation in reverse drive to be reached.

As described previously, the fluid dynamic pitch for navigation in reverse drive can be easily set by the user through the use of adjustment means, and in particular through the simple installation of an insert provided with a calibrated rod 30 of the required dimensions' or of one or more metal pins 25.

Figure 5:
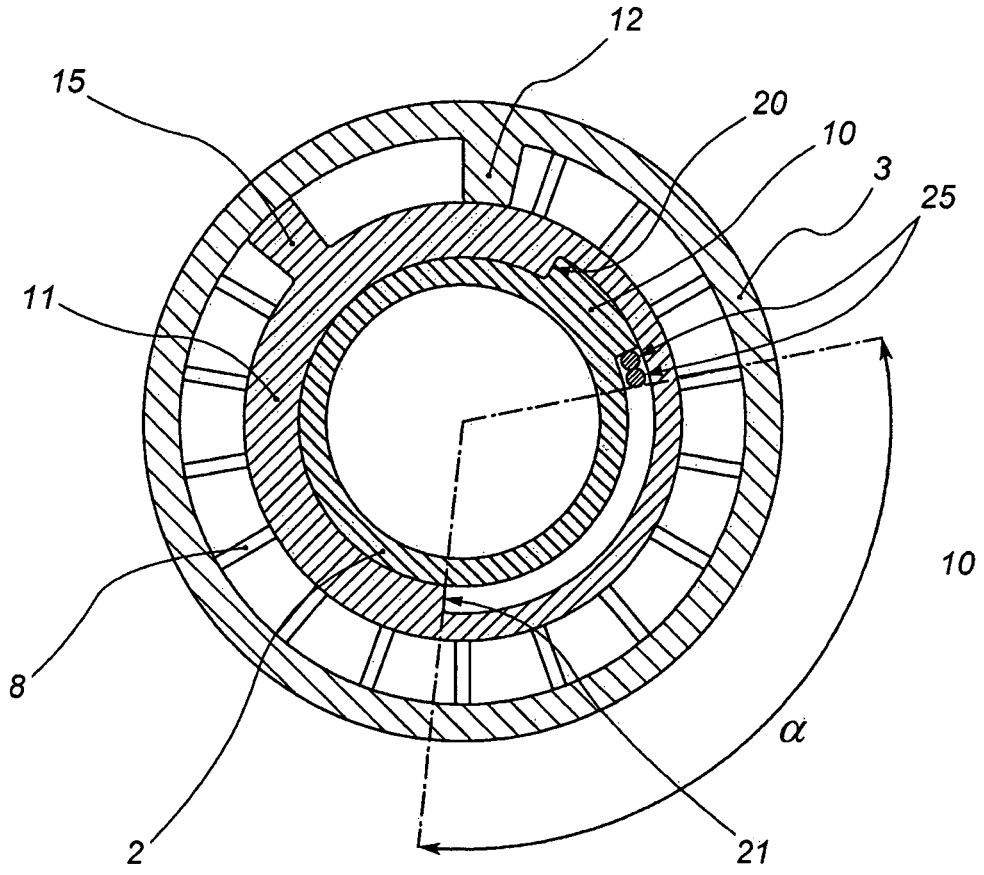
FIG. 5 shows a sectional view according to a plane perpendicular to the hub, of a further possible embodiment of the propeller according to the present invention.
Figure 6:
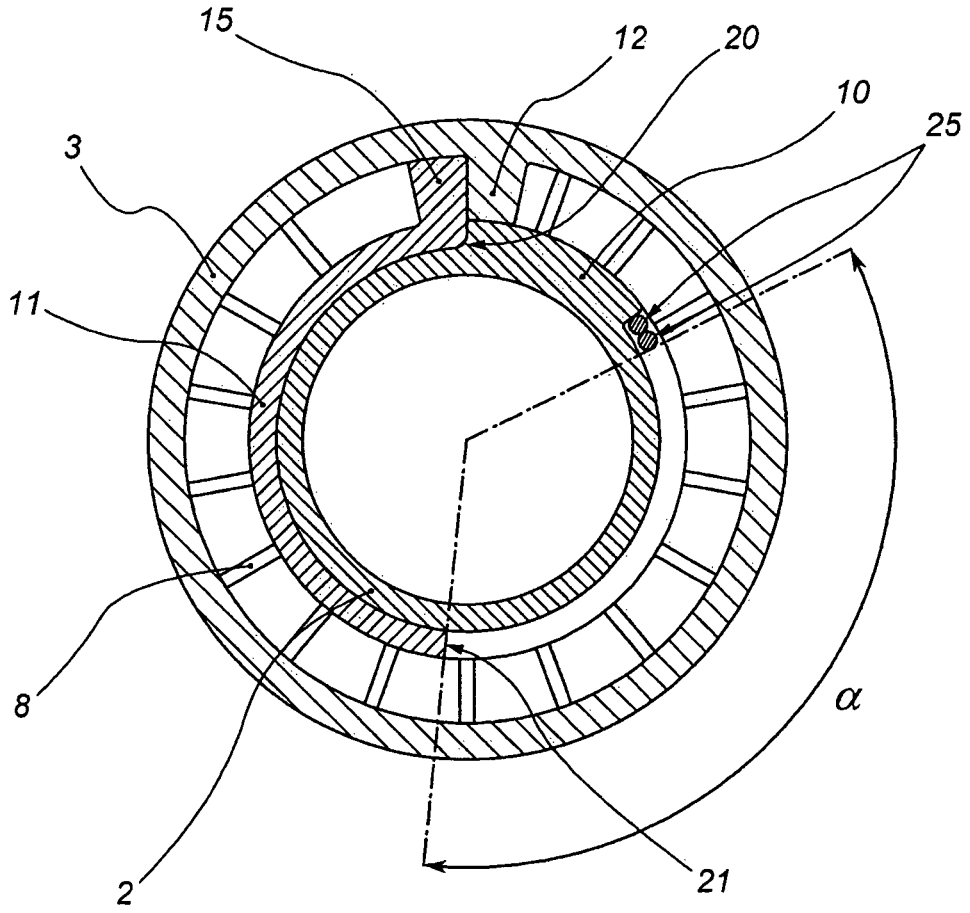
FIG. 6 shows a sectional view according to a plane perpendicular to the hub, of a further possible embodiment of the propeller according to the present invention.

FIGS. 5 and 6 show two further possible embodiments of the propeller according to the present invention.

Therefore, as previously described with reference to FIGS. 1, 2 and 2A, the presence of an angular space α for rotation of the drive shaft, or of the hub 2, with respect to the intermediate element 11, allows the blades to be positioned in a manner such that they take the most suitable pitch for navigation in reverse drive.

In particular, the user can modify the fluid dynamic pitch suitable for navigation in reverse drive in a simple manner, without having to disassemble the propeller and subject parts thereof to mechanical machining operations.

In fact, the user can modify the pitch suitable for navigation in reverse drive manually through appropriate adjustment means 30, 25, varying the rotation angle α of the drive shaft (or of the hub 2) with respect to the propeller casing 3, i.e. the rotation angle of the driving portion 10 of the hub 2 required to reach the position of contact with the second surface 21 of the intermediate element 11.

It must be noted that in the embodiment of the propeller shown in FIG. 6, unlike those shown in FIGS. 1, 2, 2A and 5, when no drive torque is applied to the drive shaft and the propeller is in the "inoperative" position (not operating), the elastic element 8 has an extension in undeformed condition such that the projecting portion 15 of the intermediate element 11 is in the position of engagement with the driven tooth 12 of the cylindrical propeller casing 3. Moreover, in the possible embodiment shown in FIG. 6, the first contact surface 20 of the intermediate element 11 is positioned corresponding to at least part of the projecting portion 15 thereof. On the contrary, as can be easily seen, in the other possible embodiments shown in FIGS. 1, 2, 2A and 5 the first contact surface 20 of the intermediate element 11 is not produced corresponding to the surface of the projecting portion 15 of the intermediate element 11.

Naturally, even if in FIGS. 5 and 6 the means to adjust the angular space α for rotation of the drive shaft with respect to the intermediate element 3 consist of metal pins 25, also in these embodiments of the propeller according to the present invention it is possible to use the calibrated rods 30, as described previously with reference to FIGS. 2, 3 and 4.

FIGS. 7A-7D show some possible embodiments of elastic elements that can be used in the propeller according to the present invention.

Figure 7A:
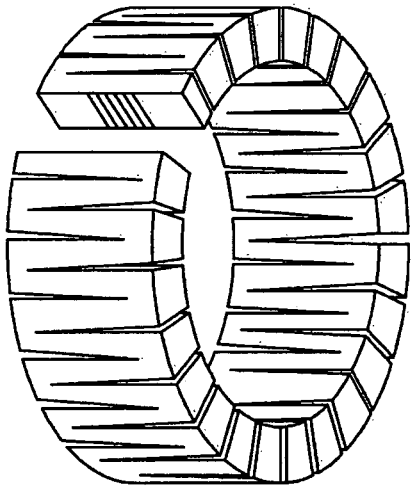
FIGS. 7A-7D show four possible embodiments of the elastic element of the propeller according to the present invention.
Figure 7B:
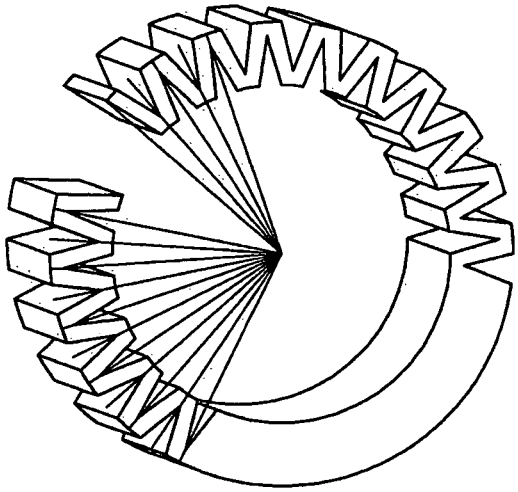

In particular, FIGS. 7A and 7B show two possible embodiments of a leaf spring provided with a plurality of notches and appropriately bent to form an elastic bushing.

In FIG. 7A the notches with which the elastic element is provided extend longitudinally, i.e. along a direction parallel to the propeller axis, while in FIG. 7B the notches extend radially along directions that converge towards the centre of the propeller.

Figure 7C:
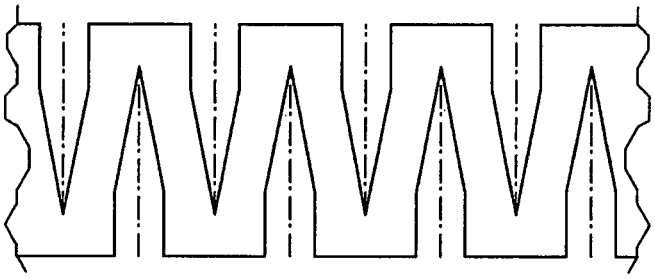
Figure 7D:
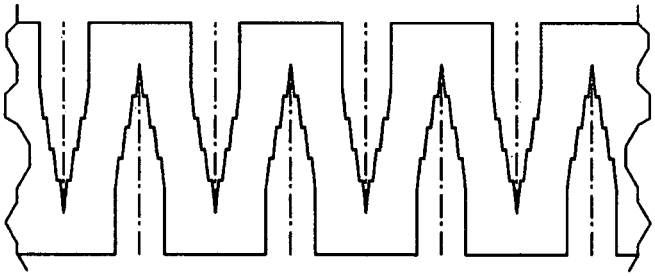

FIGS. 7C and 7D show two particular embodiments of the notches of the elastic elements. In FIG. 7C the notches have a continuous profile that can be obtained through known machining processes, such as electric discharge machining, laser jet cutting, water jet cutting, etc. Instead, the elastic element shown in FIG. 7D has notches provided with a stepped, and non-continuous profile, obtained by machining with machine tools using, for example, milling cutters with decreasing depths.

The invention claimed is:

1. A variable pitch propeller, comprising:

at least one blade pivoted rotatably to a cylindrical propeller casing, at least one of a hub and a drive shaft positioned coaxially inside said cylindrical propeller casing, a kinematic mechanism coupled to said at least one of the hub and the drive shaft, or to said cylindrical propeller casing, and to said at least one blade, for adjusting the rotary motion of said at least one blade about its axis of pivoting to said cylindrical propeller casing, and means for coupling in rotation said at least one of the hub and the drive shaft to said cylindrical propeller casing, said propeller being configured to provide at least one non-null angular range of relative rotation of said at least one blade about its axis of pivoting, with respect to said cylindrical propeller casing, or vice versa, wherein said means for coupling in rotation said at least one of the hub and the drive shaft to said cylindrical propeller casing comprise at least one elastic element interposed between said at least one of the hub and the drive shaft and said cylindrical propeller casing, and at least one intermediate element interposed between said at least one of the hub and the drive shaft and said cylindrical propeller casing, said intermediate element being provided with a first contact surface and with a second contact surface that engages with a portion of said at least one of the hub and the drive shaft, the first contact surface and the second contact surface are mutually spaced apart to allow an angular space (α) for rotation of said at least one of the hub and the drive shaft with respect to said intermediate element, and wherein said portion of said at least one of the hub and the drive shaft is a driving portion and said cylindrical propeller casing is provided internally with a driven tooth, said intermediate element being shaped to interpose directly, or indirectly, between said driving portion and said driven tooth.

2. The propeller according to claim 1, further comprising means for adjusting said angular space (α) for rotation of said at least one of the hub and the drive shaft with respect to said intermediate element.

3. The propeller according to claim 2, wherein said means for adjusting said angular space (α) for rotation of said at least one of the hub and the drive shaft with respect to said intermediate element comprise at least one calibrated rod mounted on an insert.

4. The propeller according to claim 2, wherein said means for adjusting said angular space (α) for rotation of said at least one of the hub and the drive shaft with respect to said intermediate element comprise at least one metal pin.

5. The propeller according to claim 2, wherein said means for adjusting said angular space (α) for rotation of said at least one of the hub and the drive shaft with respect to said intermediate element are interposed between said portion of said at least one of the hub and the drive shaft and said second contact surface of said intermediate element to limit rotation between said at least one of the hub and the drive shaft and said cylindrical propeller casing when said at least one of the hub and the drive shaft rotates in a direction of rotation that moves said portion of said at least one of the hub and the drive shaft toward the second contact surface.

6. The propeller according to claim 1, wherein said first and second contact surfaces are in the position of engagement with said driving portion of said at least one of the hub and the drive shaft, respectively when said at least one of the hub and the drive shaft rotates according to a first and a second direction of rotation.

7. The propeller according to claim 1, wherein said at least one elastic element is interposed between said intermediate element and said driven tooth, to adjust the relative rotation between said at least one of the hub and the drive shaft and said cylindrical propeller casing when said at least one of the hub and the drive shaft rotates in first and second direction of rotation, said driving portion being in the position of engagement respectively with said first and second contact surfaces of said intermediate element.

8. The propeller according to claim 1, wherein said intermediate element is shaped in a manner such as to comprise at least one projecting portion to engage, directly or indirectly, said driven tooth.

9. The propeller according to claim 8, wherein said elastic element is interposed circumferentially between said at least one projecting portion of said intermediate element and said driven tooth of said cylindrical propeller casing.

10. The propeller according to claim 1, wherein said elastic element is provided with notches extending parallel to the propeller axis.

11. The propeller according to claim 1, wherein said elastic element is provided with notches extending along radial directions converging in the centre of rotation of the propeller.

12. The propeller according to claim 1, wherein said elastic element is provided with notches having a continuous profile.

13. The propeller according to claim 1, wherein said elastic element is provided with notches having a stepped profile.

* * * * *